US009791164B2

(12) United States Patent
Plummer

(10) Patent No.: US 9,791,164 B2
(45) Date of Patent: Oct. 17, 2017

(54) SPIKE GUARD VENT COVER

(71) Applicant: Philbert Jimmy Plummer, Upper Marlboro, MD (US)

(72) Inventor: Philbert Jimmy Plummer, Upper Marlboro, MD (US)

( * ) Notice: Subject to any disclaimer, the term of this patent is extended or adjusted under 35 U.S.C. 154(b) by 131 days.

(21) Appl. No.: 14/545,287

(22) Filed: Apr. 17, 2015

(65) Prior Publication Data

US 2016/0305686 A1 Oct. 20, 2016

(51) Int. Cl.
*F24F 13/08* (2006.01)
*F24F 7/00* (2006.01)

(52) U.S. Cl.
CPC ..... *F24F 13/082* (2013.01); *F24F 2007/001* (2013.01)

(58) Field of Classification Search
CPC ..... F24F 13/082
See application file for complete search history.

(56) References Cited

U.S. PATENT DOCUMENTS 5,616,079 A * 4/1997 Iwase ..... A63F 13/005 345/428
5,765,319 A * 6/1998 Callaghan, Jr. ..... A01M 29/32 52/101
6,299,529 B1 * 10/2001 Preston ..... F24F 13/082 454/367
8,845,405 B2 * 9/2014 Greenberg ..... F24F 13/082 454/367

* cited by examiner

*Primary Examiner* — Sarah McPartlin
(74) *Attorney, Agent, or Firm* — Millen, White, Zelano & Branigan, P.C.; William Nixon

(57) ABSTRACT

The exhaust vent cover produces a few purposes: The exhausting of air, heat, dust, lint, fumes and other unwanted elements from the dwelling's interior to the dwelling's exterior. 1) Provides a mechanical way of preventing outside air, dirt etc. from entering the interior space/area by utilizing a mechanical flap that swings outward by air pressure, electrical motor or pneumatic control hooked to an on/off control switch. 2) Prevents birds, rodents and other small critters from entering the interior space/area. This exhaust cover is designed in three (3) parts: First part: is a molded plastic or metal hood cover with slots on sides. Second part: is an attachable frame with metal spikes surrounding the opening of the hood cover. Third part: a backdraft cover that opens outward can be made of metal or plastic, this cover which attaches with a hinge like mechanism at the top inside opening of the exhaust vent cover.

4 Claims, 8 Drawing Sheets

SPIKE GUARD VENT COVER

CROSS-REFERENCE TO RELATED APPLICATION

This application claims priority on U.S. provisional patent filed Apr. 18, 2014 which is hereby incorporated by reference herein.

FIELD OF THE INVENTION

This invention relates to the field of ventilation. More specifically, this invention relates to the field of covers or shields for exterior vent openings. More specifically, this invention relates to the field of dryer vent covers for the exterior vent opening with the spike guard to prevent birds and other small animals from entering the vent.

BACKGROUND OF THE INVENTION

Household clothes dryers work by heated air flow in drum rotation. The heated air flow must be vented outside of the building. The outdoor vent opening expels not only hot air but also lint from the clothing. Dryer vent covers must be used to cover the outdoor dryer vent opening. Dryer vent covers are designed to do three things: 1) Prevent cold air from entering into the building. 2) Prevent small pest from nesting in the dryer vent line. 3) Allow the free flow of air for the expulsion of hot air and lint. There are several dryer vent covers available on the market today. All the dryer vent covers are designed to protect the dryer vent from intrusion while allowing lint expulsion. The dryer vent covers on the market today generally utilize grates or louvers to expel lint and prevent pest nesting. There are some other models that use rotating paddles or dual-door designs.

SUMMARY OF THE INVENTION

During the past eighteen years my experience as a laundry dryer and exhaust vent cleaner, I, the inventor, have cleaned thousands of vents that are clogged with lint and bird nests due to the method of design that is presently being used. The present invention is an attachment with spikes for pest deterrence. The present invention is designed to allow lint from household clothes dryer vents and other exhaust vent covers to be vented outdoors while preventing birds and small animals from building a nest in the exhaust vent. Birds and small animals enter an exhaust vent opening from the outside of a property and build their nest. Dryer vent lint and other materials that should be vented outside are trapped in the exhaust vent. This spike attachment prevents birds from entering the exhaust vent and creating blockages and at the same time allows the free flow of air for a variety of exhaust vents, including but not limited to, dryer exhaust vents, bathroom exhaust vents, kitchen exhaust vents and roof exhaust vents.

After doing searches on dryer vents and exhaust vent covers, I the inventor was unable to find any covers that use the principles and design as the present invention. The bird guards and exhaust vent covers that are presently marketed, sold, and installed use a square pattern screen at the opening or parallel wire spaced a half of an inch apart, covering the opening of the bird guard or exhaust vent cover. Even though these vent covers will prevent birds from entering, the vent still enables lint to become trapped, creating a fire hazard from lint build up and heat from the dryer.

BRIEF DESCRIPTION OF DRAWINGS

In reference to FIG. 1 (Angle View) shows an overall view of dryer 1 vent cover with 3 Spike Guard attachment, 4 Spikes, 5 Slots on the Vent cover, and 6 Mounting holes.

In reference to FIG. 2 (Front View) of 1 vent cover shows 6 mounting holes and direction, 2 Slots in vent cover, 3 Bird Guard attachment, 4 Bird Guard spikes.

Figure 3:
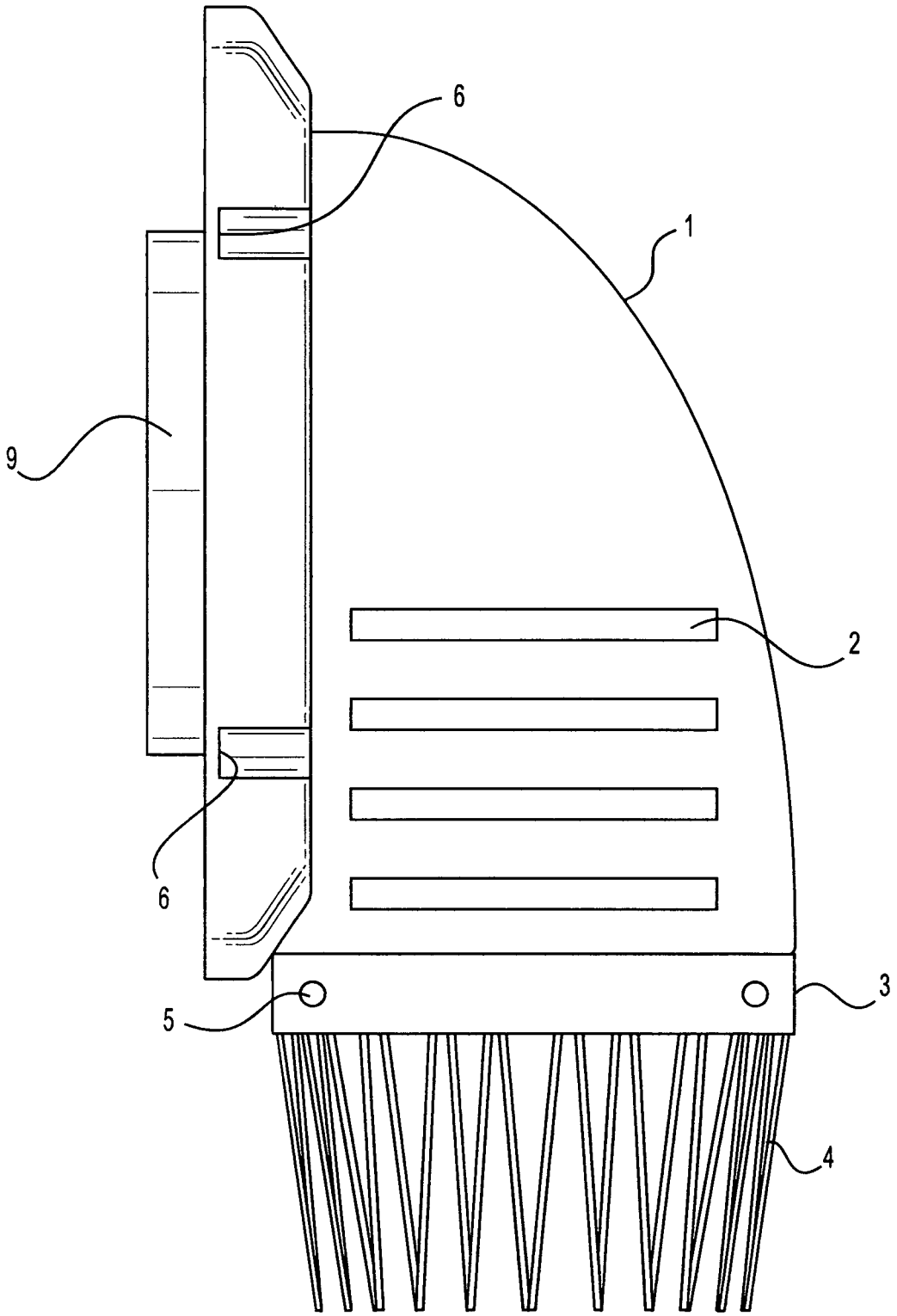

In reference to FIG. 3 (Side View) of 1 vent cover demonstrating the angular slope of the vent, 2 Slots on the side (openings), 3 Spike Guard attachment, 4 Spikes, 9 Flange profile which attaches the pipe, hose or duct which connects to the dryer or other component.

Figure 4:
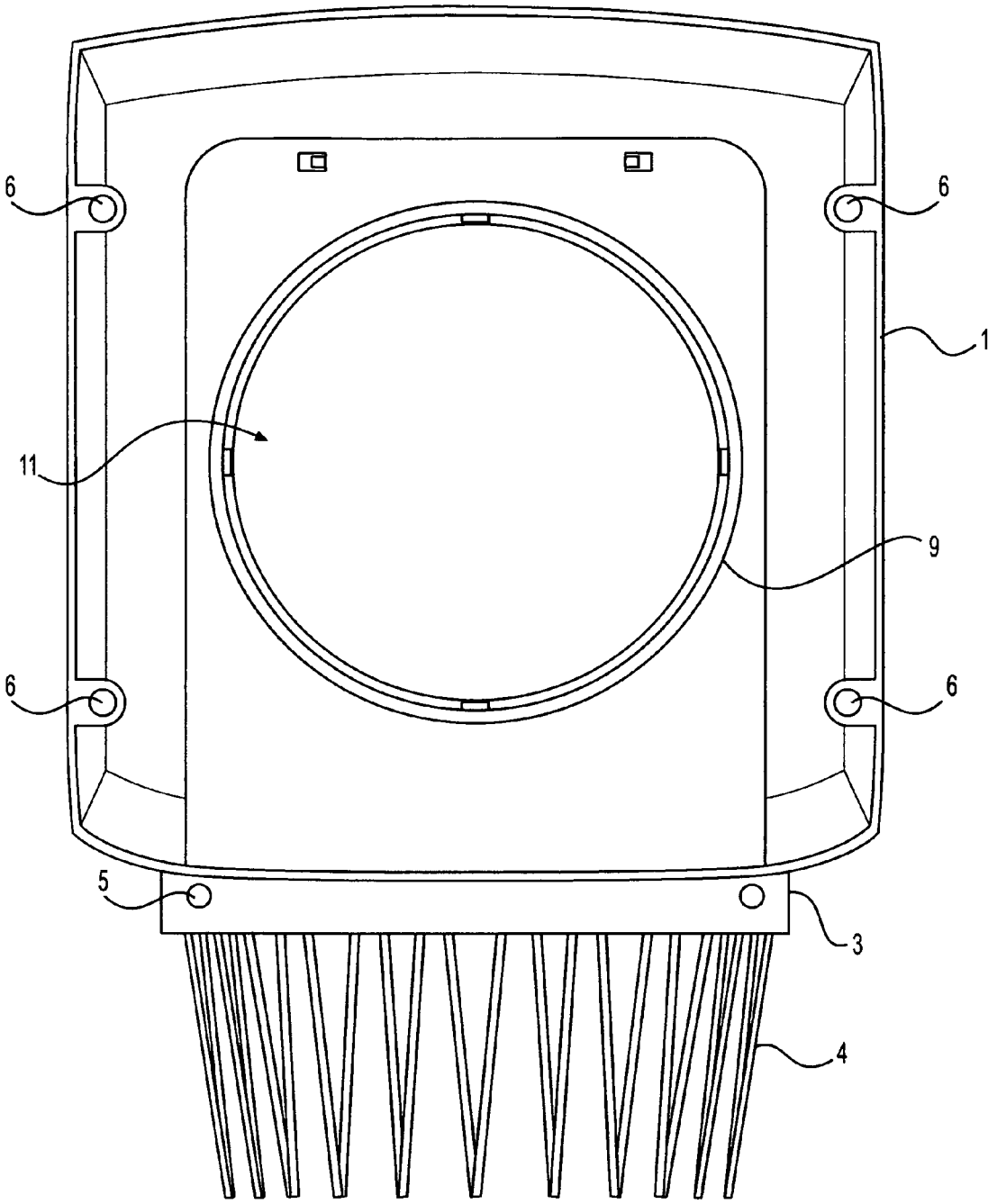

In reference to FIG. 4 (Back View) of 1 vent cover with 6 Mounting holes, 9 Flange on vent cover for connecting pipe or hose or duct, 3 Bird Guard attachment, 4 Spikes on the attachment, 11 Back draft flap.

Figure 5:
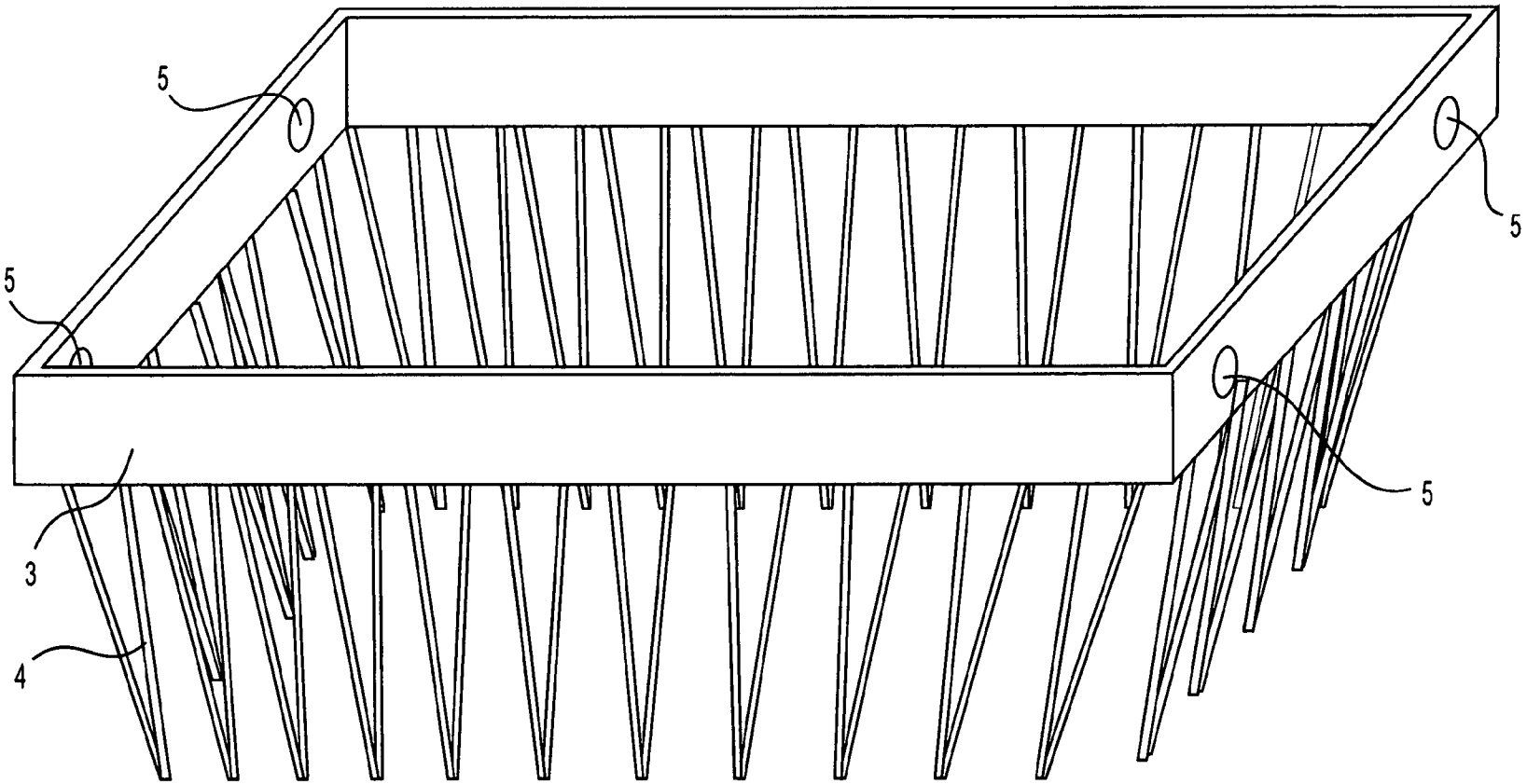

In reference to FIG. 5 (Spike Guard Attachment) 3 with 4 Spikes illustrated to meet at the bottom forming a funneling shape and an enclosure to prevent birds and rodents from entering however, spikes may be reconfigured differently to be most effective for its purpose, 5 Holes for Mounting the Spike Guard to vent cover.

Figure 6:
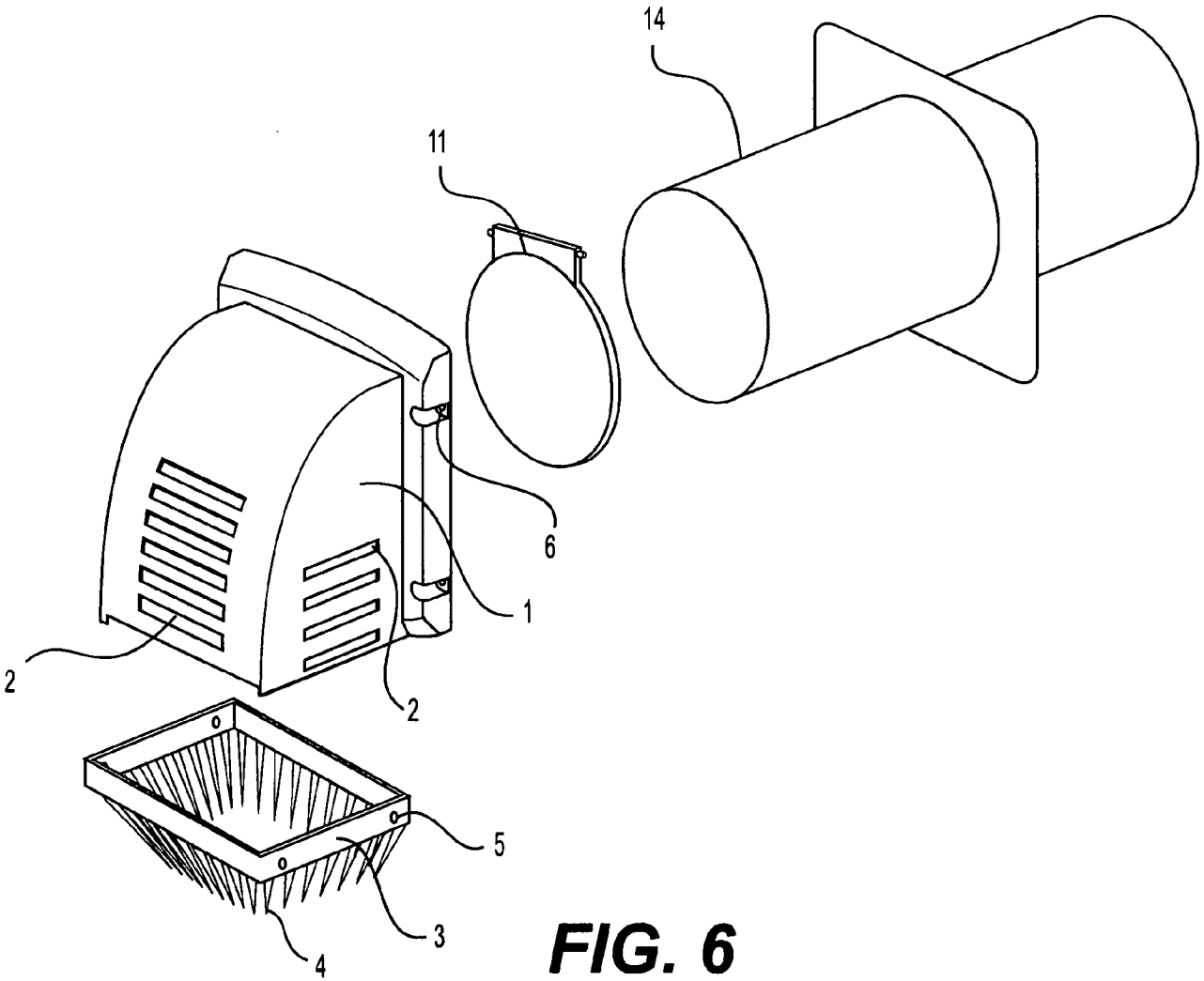

In reference to FIG. 6 (Exploded View) of 1 Vent cover, 2 Slots (openings), 6 Mounting holes, 3 Spike Guard attachment, 4 Spikes, 5 Spike Guard Mounting Holes 11 Back draft flap and 14 Pipe, Hose or Duct that can be connected to 9 Flange.

Figure 7:
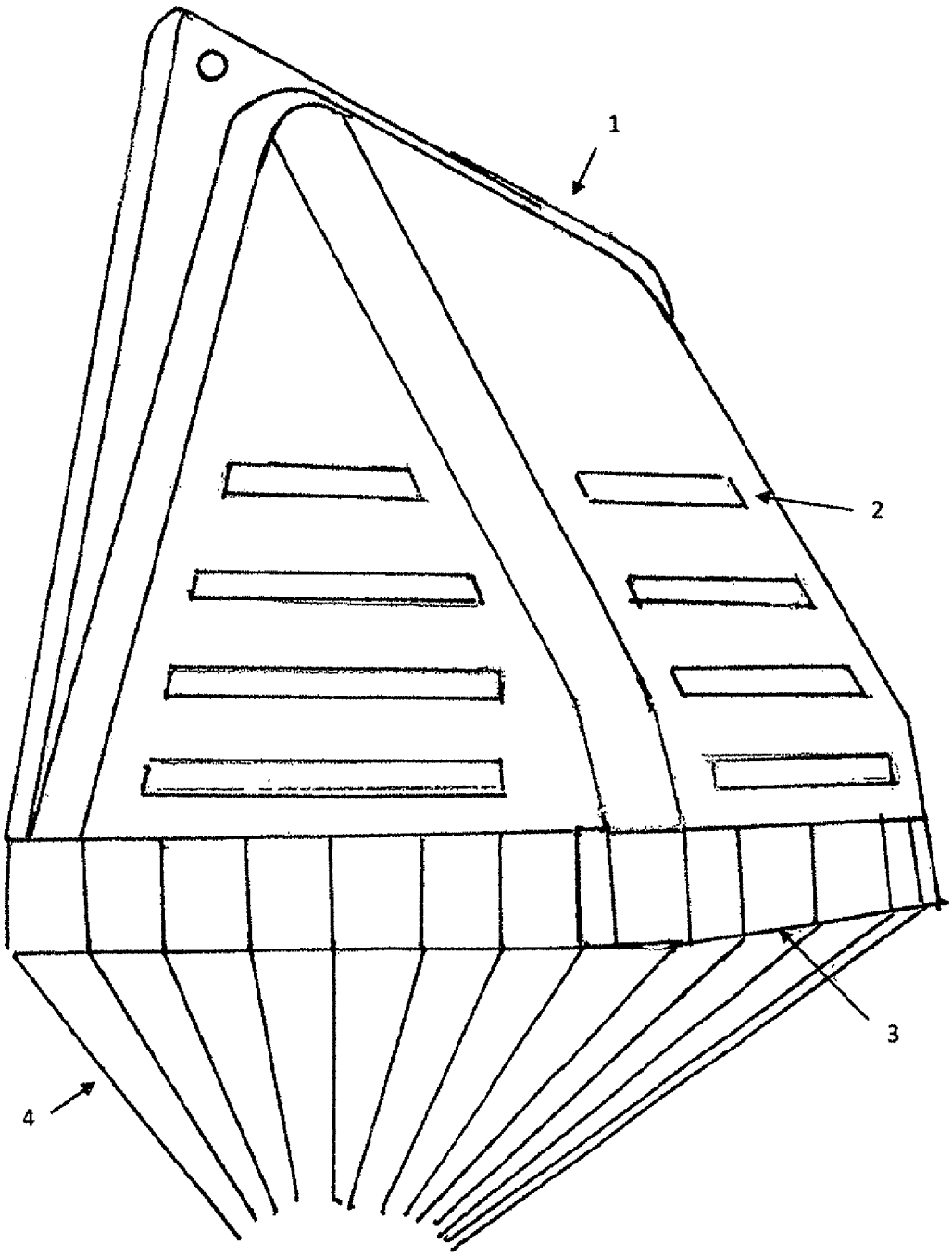

FIG. 7. Provides a perspective view of a dryer vent cover 1 according to another embodiment.

Figure 8:
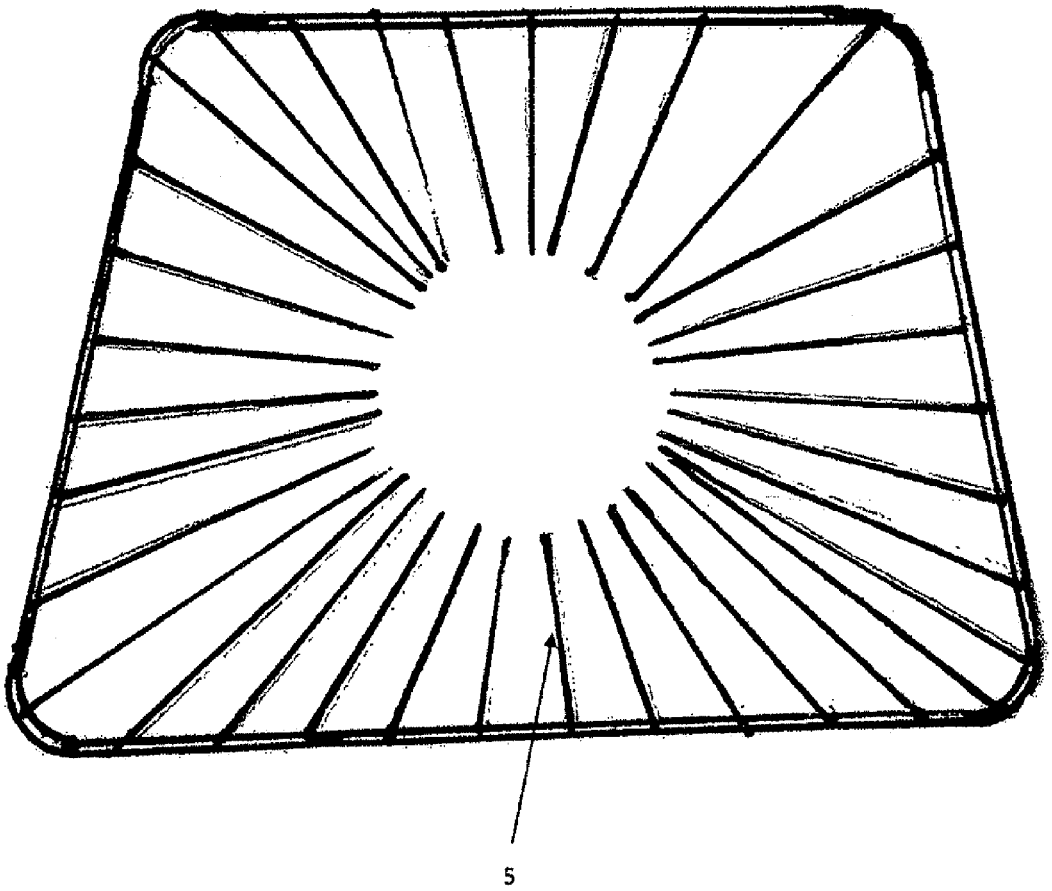

FIG. 8. Depicts a top view of spike guard attachment 3 of this embodiment.

DETAILED DESCRIPTION OF DRAWINGS

The present invention is a result of my experience as a dryer and vent cleaning specialist for over the past 18 years. I have dealt with all the major vent covers and bird guards and have seen firsthand their limitations compared to the "Spike Guard Vent Cover".

Figure 1:
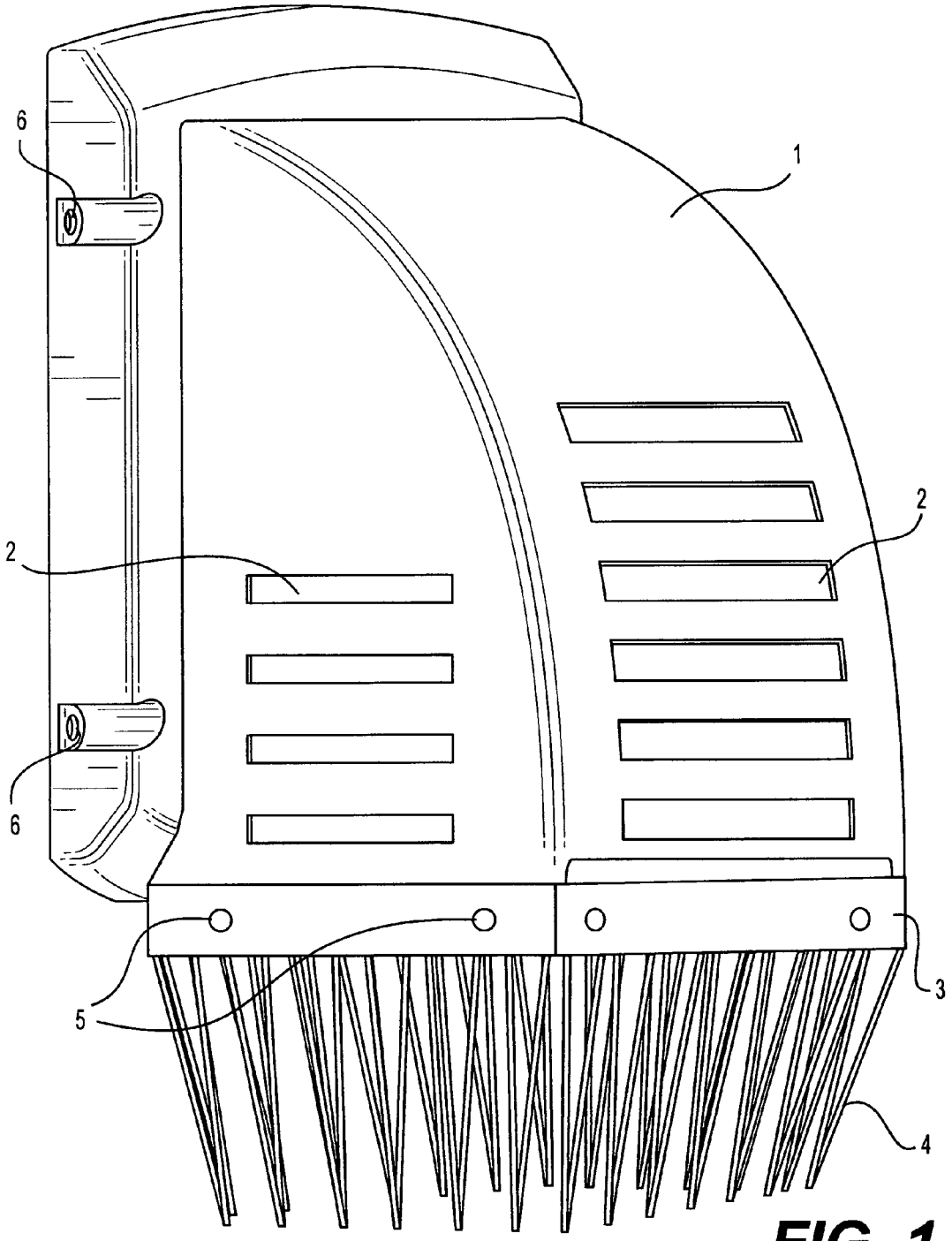

FIG. 1 (Angle View) shows the sloping angle of 1 Vent Cover which is best designed to deal with snow, sleet and rain. This vent cover can be manufactured from plastic or metal. 2 Shows slots (openings) on sides of the vent cover. They serve as three main purposes: 1) allow outdoor air and high winds to have a self cleaning effect on Spike attachment; 2) to help dissipate hot humid air more efficiently; 3) to allow rain to wash lint and dirt from Spike Guard. 3 Spike Guard attachment can be manufactured from plastic, metal or a combination of both. The Spikes are illustrated pointing down into a conical shape but not limited to this pattern or design and can be reconfigured to the most effective and practical manner by those skilled in the art. 4 Spikes can be manufactured with stainless steel or ultra violet resistant plastic. 3 Spike Guard is removable 5 Spike Guard Component Mounting Holes for attaching and detaching to vent cover and for servicing access. 6 Vent Cover Mounting Holes for attaching vent cover to substrate wood, plastic, metal and concrete etc.

Figure 2:
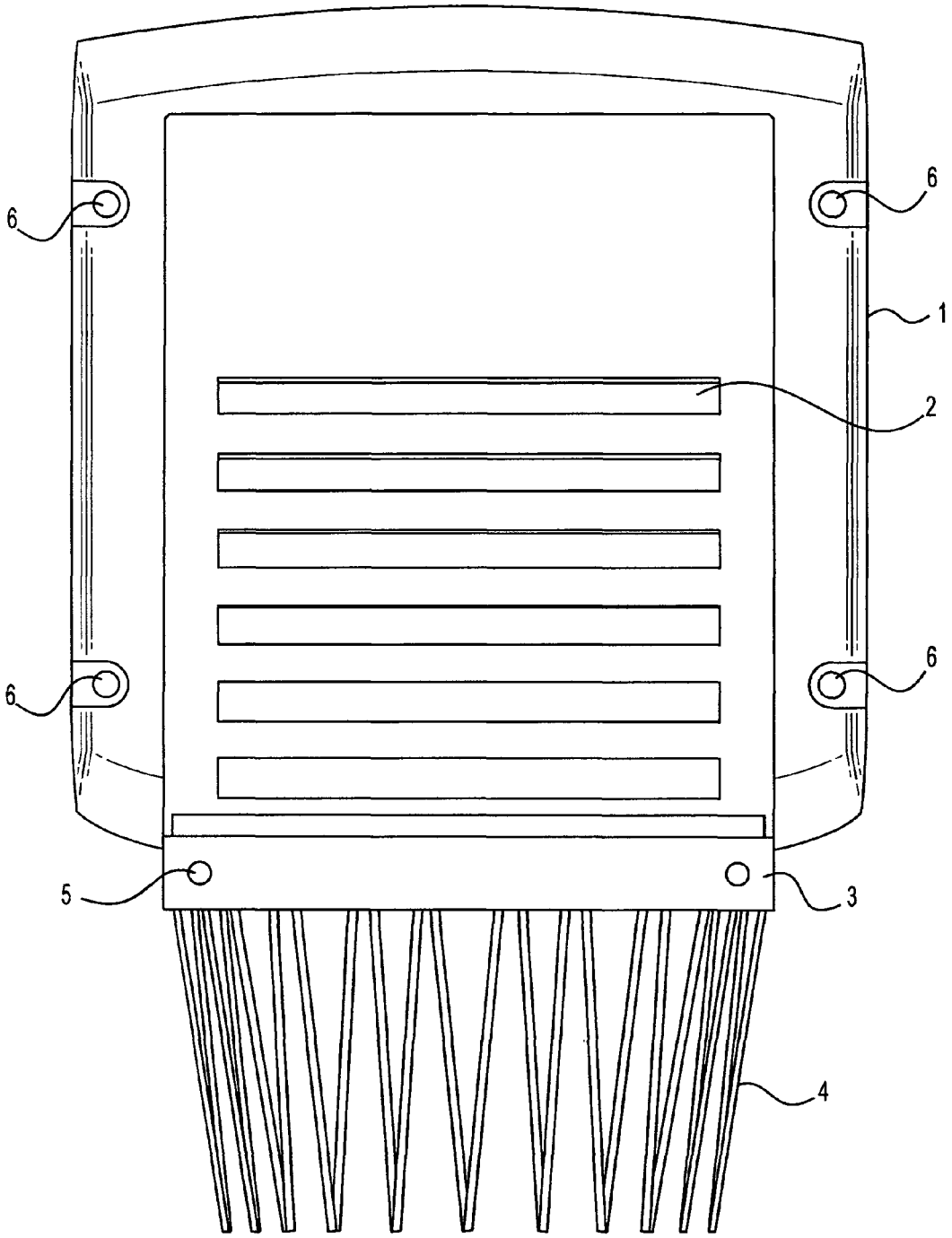

FIG. 2 (Front View) of vent cover showing 6 Four Mounting Holes for Vent Cover, 2 Slots on front of cover, 3 Spike Guard and 4 Spikes.

FIG. 3 (Side View) of vent cover showing 2 Slots, 6 Mounting Holes for Vent Cover, 3 Spike Guard and 4 Spikes, 9 Flange on vent cover for attaching to duct pipe or hose.

FIG. 4 (Back View) of vent cover showing 6 Mounting Holes for Vent Cover, 9 Flange for connecting vent cover to exhaust pipe, hose or duct 11 Back draft damper open towards front of vent cover the top held in place by pivot that allows opening when air pressure is applied from component and closes back by gravity with the absence of air pressure thereby keeping rain, wind, insects out. 3 Spike Guard attachment, 4 Spikes.

FIG. 5 (Spike Guard) attachment (to the vent cover) with spikes showing spikes in a downward conical shape that may be reconfigured by one skilled in the art in order to utilize the most effective position of spikes to achieve best air flow and allowing the outdoor elements such as wind, rain to keep clean while keeping birds and small animals from entering through and into the dryer vent cover.

FIG. 6 (Exploded View) of dryer #1 vent cover and 3 Spike Guard, 11 Back draft damper attaches to dryer vent cover by pivot on top which swings outward when air pressure is applied by component in interior of building 14 Pipe Hose or Duct connects to 9 Vent Guard assembly.

FIGS. 7 and 8 show different embodiments of dryer vent cover 1. As can be seen, spikes 4 may have a single portion that converges downwardly from spike guard attachment

I claim:

1. An exhaust vent cover comprising:

a front having a sloped portion;

sides connected the front, wherein the front and the sides are configured to form an opening;

a mount to hold the front and the sides over an exhaust vent;

a plurality of slots within the front and sides, wherein the slots are parallel and offset from each other; and a guard attachment connected to a bottom of the front and to each bottom of the sides to cover the opening, wherein the guard attachment includes a plurality of spikes, the spikes configured to converge downward and inward from the opening to form a funnel for air exiting the opening and to prevent entrance to the exhaust vent by birds or animals.

2. The exhaust vent cover of claim 1, wherein the plurality of slots are configured to direct air downwards towards the spikes.

3. The exhaust vent cover of claim 1, wherein the spikes are comprised of metal or plastic.

4. The exhaust vent cover of claim 1, wherein each of the spikes include a spaced portion to allow the air to flow through.

* * * * *